US011304478B2

(12) United States Patent
Berberian

(10) Patent No.: US 11,304,478 B2
(45) Date of Patent: Apr. 19, 2022

(54) CONVERTIBLE SHOE HAVING A LOCKING ACTUATOR

(71) Applicant: High-Low Heel, LLC, Vancouver, WA (US)

(72) Inventor: Maria Mercedes Berberian, Vancouver, WA (US)

(73) Assignee: High-Low Heel, LLC, Vancouver, WA (US)

( * ) Notice: Subject to any disclaimer, the term of this patent is extended or adjusted under 35 U.S.C. 154(b) by 0 days.

(21) Appl. No.: 17/231,878

(22) Filed: Apr. 15, 2021

(65) Prior Publication Data

US 2021/0321719 A1 Oct. 21, 2021

Related U.S. Application Data

(60) Provisional application No. 63/010,634, filed on Apr. 15, 2020.

(51) Int. Cl.

| | |
|---|---|
| ***A43B 21/433*** | (2006.01) |
| ***A43B 21/50*** | (2006.01) |
| ***A43B 21/37*** | (2006.01) |
| ***A43B 21/48*** | (2006.01) |

(52) U.S. Cl.

CPC ..... *A43B 21/433* (2013.01); *A43B 21/37* (2013.01); *A43B 21/48* (2013.01); *A43B 21/50* (2013.01)

(58) Field of Classification Search

CPC ..... A43B 21/37; A43B 21/42; A43B 21/44; A43B 21/47; A43B 21/48; A43B 21/50; A43B 21/51

See application file for complete search history.

(56) References Cited

U.S. PATENT DOCUMENTS

| | | | | |
|---|---|---|---|---|
| 1,743,543 A * | 1/1930 | Gutierrez | ..... | A43B 21/48 36/42 |
| 9,877,537 B2 | 1/2018 | Berberian | | |
| 9,936,761 B2 * | 4/2018 | Alan | ..... | A43B 3/246 |

(Continued)

FOREIGN PATENT DOCUMENTS

| | | | | |
|---|---|---|---|---|
| WO | 2014077864 A1 | 5/2014 | | |
| WO | WO-2014198257 A1 * | 12/2014 | ..... | A43B 21/48 |
| WO | WO-2017027804 A1 * | 2/2017 | ..... | A43B 21/37 |

OTHER PUBLICATIONS

International Search Report and Written Opinion of the International Searching Authority from the Korean Intellectual Property Office, in PCT/US2021/027527 dated Aug. 4, 2021, which is an international application corresponding to this U.S. application.

*Primary Examiner* — Ted Kavanaugh
(74) *Attorney, Agent, or Firm* — Kolitch Romano LLP

(57) ABSTRACT

Systems and methods for securing a removable heel that is otherwise removably attached to a heel receiver of a shoe. The heel receiver has a fixed hook portion and a movable hook portion including a body received by an internal cavity of the heel receiver and disposed opposite the fixed hook portion. The movable hook portion is configured to move between a retracted position and an extended position, where the removable heel is secured to the shoe when the movable hook portion is in the extended position. Securing the heel includes inserting a locking pin into the internal cavity to prevent movement of the hook portion from the extended position to the retracted position.

20 Claims, 9 Drawing Sheets

(56) References Cited

U.S. PATENT DOCUMENTS

| | | | | |
|---|---|---|---|---|
| 10,039,340 | B2 | 8/2018 | Berberian | |
| 10,426,225 | B2 | 10/2019 | Berberian | |
| 2008/0060220 | A1 | 3/2008 | Lyden | |
| 2013/0247412 | A1 | 9/2013 | Du Coeur | |
| 2014/0259777 | A1 | 9/2014 | Morris Thill | |
| 2014/0298685 | A1* | 10/2014 | Alan | A43B 21/48 36/100 |
| 2017/0042276 | A1* | 2/2017 | Alan | A43B 3/246 |
| 2018/0146740 | A1* | 5/2018 | Berberian | A43B 7/1435 |
| 2018/0338582 | A1* | 11/2018 | Berberian | A43B 7/1435 |

* cited by examiner

CONVERTIBLE SHOE HAVING A LOCKING ACTUATOR

CROSS-REFERENCES

The following applications and materials are incorporated herein, in their entireties, for all purposes: U.S. Provisional Patent Application Ser. No. 63/010,634, filed Apr. 15, 2020.

FIELD

This disclosure relates to systems and methods for footwear. More specifically, the disclosed embodiments relate to footwear convertible between multiple different heel arrangements.

INTRODUCTION

Style and comfort do not always go hand in hand. This is especially true when it comes to women's footwear. High heels, though a mainstay in most women's closets, fall short of being reasonably designed footwear. The height difference between the front and rear of these shoes causes wobbling and slipping even on unadorned, planar surfaces. Despite this, women continue to wear these fashion statements even though the original purpose of high heels, that of helping a rider secure their stance in the stirrups so they could shoot arrows more effectively from horseback, no longer exists. Through the years, high heels evolved into stilettos and pumps and have succumb to iconic branding such that many see such shoes as status symbols for success and perhaps femininity.

Unfortunately, continued use of elevated footwear leads to a plethora of physical problems manifesting itself in such things as planter fasciitis and neuroma while affecting other areas of the body such as the calves, knees and lower back. The American Podiatric Medical Association reports that women have four times as many foot issues as do men. High heels are dangerous to walk in and are subject to immediate frictional engagement with sidewalk grates and the like. The most common complaint about high heels is that they are slow and uncomfortable to walk in. For this reason, many working women carry a second pair of shoes, ones with a low heel or a shoe of a walking/running variety, to get them to and from the workplace. Since shoes accumulate dirt in use, this strategy not only requires one to carry a second set of shoes, it also requires a bag in which to transport them. For most women who carry a purse, this means both arms are full. The situation is worsened if there is a personal computing device such as a laptop computer or tablet that also must be transported daily to work.

Accordingly, a single pair of shoes that could be converted between a fashionable high and a comfortable low heel would fulfill a long-felt need in the footwear industry. The examples described in the present disclosure utilize and combine known and new technologies in a unique and novel configuration to develop a convertible shoe that overcomes the aforementioned problems and provides a solution to a common workplace dilemma.

SUMMARY

The present disclosure provides systems, apparatuses, and methods relating to convertible footwear.

In some examples, an article of footwear includes: a sole including a heel receiver having a fixed hook portion and a movable hook portion comprising a body received by an internal cavity of the heel receiver and disposed opposite the fixed hook portion, wherein the movable hook portion is configured to move between a retracted position and an extended position; a first heel releasably securable to the heel receiver, wherein when the first heel is engaged with the heel receiver: (a) the first heel is secured to the heel receiver when the movable hook portion is in the extended position, and (b) the first heel is releasable from the heel receiver when the movable hook portion is in the retracted position; and a locking mechanism having an actuator portion operatively connected to a blocking portion configured to move within the internal cavity of the heel receiver, such that the locking mechanism selectively prevents movement of the movable hook portion into the retracted position.

In some examples, an article of footwear includes: a sole including a heel receiver having a fixed hook portion and a movable hook portion comprising a body received by an internal cavity of the heel receiver and disposed opposite the fixed hook portion, wherein the movable hook portion is configured to move between a retracted position and an extended position; a heel releasably securable to the heel receiver, wherein when the heel is engaged with the heel receiver: (a) the heel is secured to the heel receiver when the movable hook portion is in the extended position, and (b) the heel is releasable from the heel receiver when the movable hook portion is in the retracted position; and a locking mechanism having an L-shaped actuator portion operatively connected to a blocking portion configured to move within the internal cavity of the heel receiver, such that the locking mechanism selectively prevents movement of the movable hook portion into the retracted position; wherein the movable hook portion is biased toward the extended position by a helical spring extending between the body of the movable hook portion and a wall of the internal cavity.

In some examples, a method of securing a removable heel to a shoe includes: attaching a removable heel to a heel receiver of a shoe, wherein the heel receiver has a fixed hook portion and a movable hook portion comprising a body received by an internal cavity of the heel receiver and disposed opposite the fixed hook portion, wherein the movable hook portion is configured to move between a retracted position and an extended position, wherein the removable heel is secured to the shoe when the movable hook portion is in the extended position; and causing an insertion of a locking pin into the internal cavity to prevent movement of the movable hook portion from the extended position to the retracted position.

Features, functions, and advantages may be achieved independently in various embodiments of the present disclosure, or may be combined in yet other embodiments, further details of which can be seen with reference to the following description and drawings.

DETAILED DESCRIPTION

Figure 1:
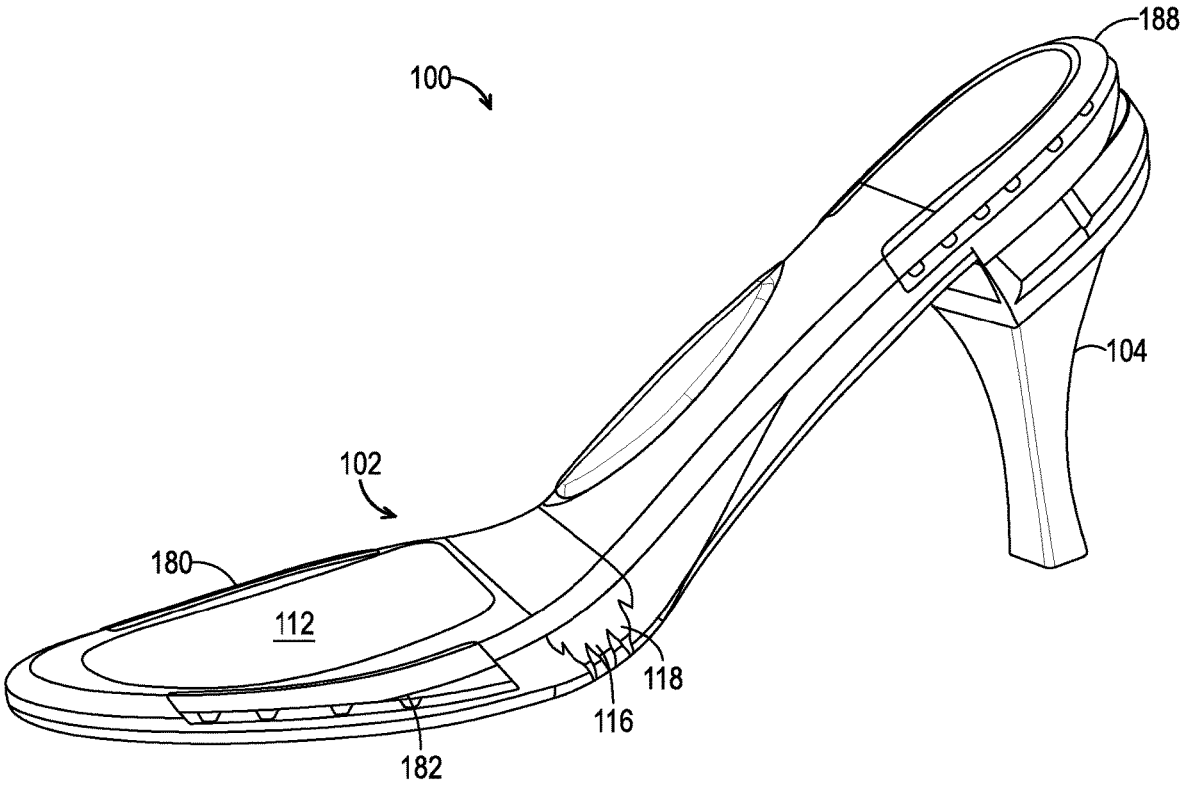
FIG. 1 is an isometric view of an illustrative convertible shoe in accordance with aspects of the present disclosure.

Various aspects and examples of a convertible shoe are described below and illustrated in the associated drawings. Unless otherwise specified, a convertible shoe in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections, each of which is labeled accordingly.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"Resilient" describes a material or structure configured to be deformed elastically under normal operating loads (e.g., when compressed) and to return to an original shape or position when unloaded.

"Rigid" describes a material or structure configured to be stiff, non-deformable, or substantially lacking in flexibility under normal operating conditions.

"AKA" means "also known as," and may be used to indicate an alternative or corresponding term for a given element or elements.

Directional terms, such as "inboard," "outboard," "front," and "rear" (and the like) are intended to be understood in the context of the article of footwear on or in which components described herein may be mounted or otherwise attached. For example, "outboard" may indicate a relative position that is laterally farther from the centerline of a shoe, or a direction that is away from the shoe's longitudinal centerline. Conversely, "inboard" may indicate a direction toward the centerline, or a relative position that is closer to the centerline. Similarly, "forward" or "front" means toward the toe portion of the footwear, and "rear" or "back" means toward the heel portion of the footwear. Similarly, the term "longitudinal" generally refers to the heel-to-toe (length) direction of the footwear, while the term "lateral" generally refers to the side-to-side (width) direction of the footwear. In the absence of a host article of footwear, the same directional terms may be used as if the article were present. For example, even when viewed in isolation, a component may have a "forward" side, based on the fact that the component would be installed with the side in question facing in the direction of the toe portion of a shoe.

"Coupled" means connected, either permanently or releasably, whether directly or indirectly through intervening components.

In this disclosure, one or more publications, patents, and/or patent applications may be incorporated by reference. However, such material is only incorporated to the extent that no conflict exists between the incorporated material and the statements and drawings set forth herein. In the event of any such conflict, including any conflict in terminology, the present disclosure is controlling.

Overview

When one shifts from walking on low heels to high heels the foot bends at the metatarsophalangeal joints located between the base of the proximal phalanx bones and the head of the metatarsal bones. The plantar fascia is then stretched beneath the tarsal bones. Thus, less of the weight of the person is carried by the calcaneus bone and more of the weight is carried by the metatarsal bones. Like walking on tip toes, this leaves this plantar fascia under tension, causing discomfort. Accordingly, a shoe having a plurality of heel components is described herein. The heel components are attachable to a heel attachment mechanism disposed on the bottom of the heel end of the shoe. Furthermore, the heel components may be locked into the heel attachment mechanism by a locking actuator that ensures the heel component is retained during use. In some examples, the locking mechanism is externally accessible.

In general, locking actuators of the present disclosure are configured to secure the heel component to the heel attachment mechanism, such that accidental dislodgment of the heel component is prevented. The locking actuator includes a locking feature configured to prevent the heel component from accidentally decoupling from the heel attachment mechanism.

Examples, Components, and Alternatives

The following sections describe selected aspects of illustrative convertible shoes as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative Convertible Shoe Having A Locking Actuator

As shown in FIGS. 1-9, this section describes an illustrative convertible shoe having a locking actuator, an example of the convertible shoe described above.

With reference to FIG. 1, shoe 100 includes a sole 102 and a number of interchangeable heel portions that are releasably securable to the sole. In the present example, shoe 100 includes a high heel portion 104 and a low heel portion 106, also referred to as a tall heel portion and a short heel portion, though any number of unique heel portions may be envisioned. Shoe 100 may additionally include an upper, having suitable portions configured to hold the shoe on a foot of the user. For example, shoe 100 may include a toe strap and a heel strap (not shown).

Figure 2:
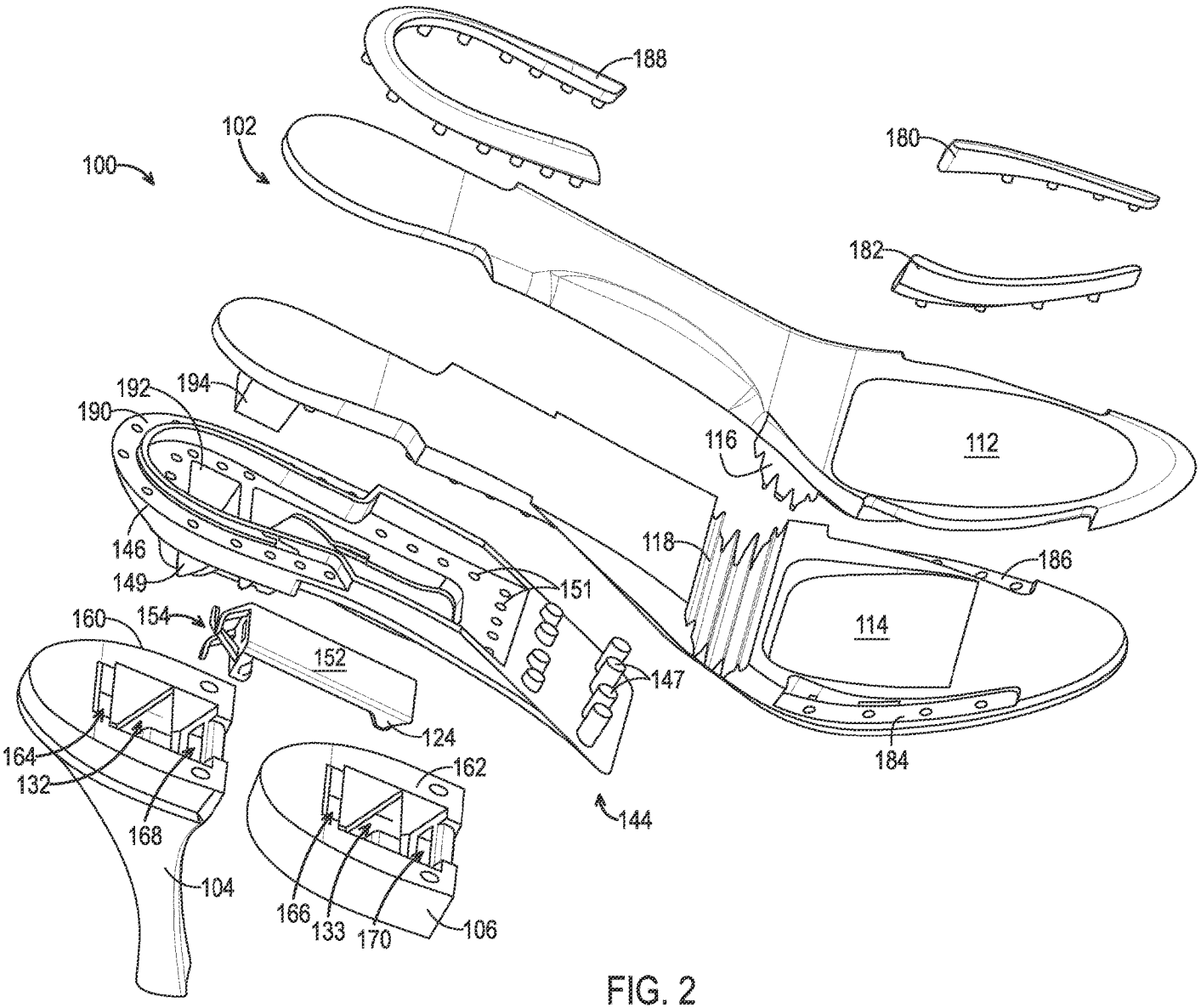
FIG. 2 is an exploded view of the convertible shoe of FIG. 1.
Figure 3:
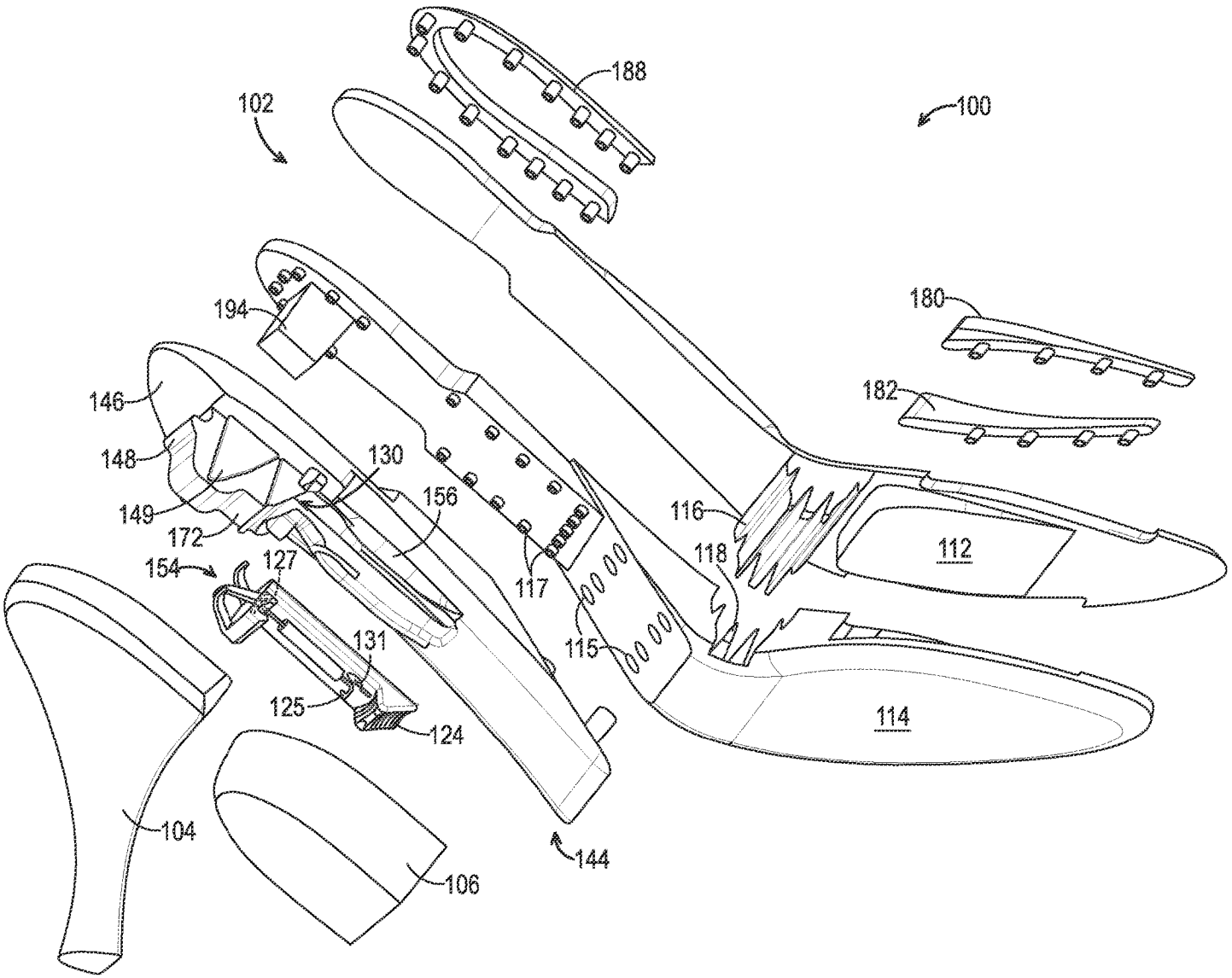
FIG. 3 is an exploded view of the convertible shoe of FIG. 1.

As shown in the exploded views of FIGS. 2 and 3, sole 102 includes an insole portion 112 generally layered atop an outsole portion 114. As described above, the insole portion and outsole portion may each comprise any suitable materials, such as varieties of thermoplastic polyurethane (TPU). In general, outsole portion 114 may include a tougher, less resilient material than insole portion 112, e.g., for wear-resistance. Insole portion 112 may include a softer, more resilient material than outsole portion 114, e.g., for comfort. For example, outsole portion 114 may include a more rigid TPU than insole portion 112, such that chemically speaking the TPU of the outsole has a greater ratio of hard to soft segments than the TPU of the insole. Insole portion 112 may be referred to as a soft sole. In some examples, sole 102 may include more or fewer layers than the two layers described in this example.

Portions of the upper may be secured to sole 102 by one or more clamp plates. For example, a toe strap, heel strap, and/or other upper components can be secured to sole 102 by one or more clamp plates. As shown in FIG. 2, clamp plates 180, 182 and corresponding recessed clamp plate receivers 184, 186 may be utilized on a front (i.e., toe) end of the sole. Each clamp plate 180, 182 includes a plurality of pins and/or other suitable protrusions configured to pass through corresponding apertures in a toe strap. In some examples, clamp plates 180 and 182 may be crescent-shaped. The pins are further configured to mate with receiving holes in the corresponding clamp plate receivers 184 and 186 to secure the toe strap to the shoe.

Similarly, clamp plate 188 and corresponding recessed clamp plate receiver 190 may be utilized on a rear (i.e., heel) end of the sole. Clamp plate 188 includes a plurality of pins and/or other suitable protrusions configured to pass through corresponding apertures in a heel strap. The pins are further configured to mate with receiving holes in clamp plate receiver 190, which is disposed at a heel end of the sole.

Insole portion 112 includes an extension or enlargement in the form of a ridged or toothed cushion 116 disposed in a region of the insole where a user's metatarsophalangeal (MTP) joints (i.e., the heads of the metatarsal bones) would typically exert pressure. Cushion 116 may comprise the relatively soft and/or resilient material of insole portion 112, and may be unitary with the insole portion. As depicted in this example, cushion 116 mates with (i.e., is received by) a corresponding cushion receiver 118 disposed in outsole portion 114. Cushion receiver 118 includes complementary ridges or teeth configured to engage the teeth of cushion 116 for security and resilience. Accordingly, as with shoe 400, a thicker portion of the insole extends into a recess of the outsole in a region of the sole corresponding to metatarsophalangeal joints of a user.

With continued reference to FIG. 3, a heel attachment mechanism 144 is included in shoe 100. Heel attachment mechanism 144 may include any suitable structure and/or device configured to releasably secure a heel portion to the sole.

In this example, heel attachment mechanism 144 includes a heel receiver 146 (AKA a hard sole or hard rear portion). Heel receiver 146 may be affixed to sole 102 using any suitable fastener (e.g., by an adhesive). In this example, heel receiver 146 is affixed to outsole 114 by a plurality of pins or protrusions 147 formed in heel receiver 146 and configured to mate with receiving holes 115 in outsole 114. Additionally, to increase security, outsole 114 has a plurality of pins or protrusions 117 configured to mate with receiving holes 151 in heel receiver 146. The inclusion of protrusions 147 and 117 and holes 151 and 115 on heel receiver 146 and outsole 114 increases the robustness of heel attachment mechanism 144 and enables shoe 100 to withstand the forces involved with standing and walking for prolonged times without failure of the heel portions or heel receiver.

Furthermore, in this example, a recess 192 is formed in an upper surface of heel receiver 146. A corresponding block 194 is formed on or coupled to a bottom surface of outsole 114. Block 194 is configured to mate with recess 192, thereby further increasing the security of heel receiver 146.

Outsole 114 includes a slot or space configured to accommodate an extension or tongue portion of heel receiver 146. Outsole 114 additionally includes a protective cover proximate the space configured to cover the interface between outsole 114 and heel receiver 146. This configuration provides increased rigidity in the bottom of shoe 100, e.g., to further withstand the forces involved with prolonged standing and walking. The tongue portion may include a curved section configured to follow the curve of shoe 100 below the region where the user's MTP joints typically exert pressure. The curved section allows for the tongue portion to extend further towards the toe-end of shoe 100 and accommodate the general curve of sole 102.

When assembled, heel receiver 146 interlocks with outsole 114 such that the tongue portion is received by and housed within the space.

Heel receiver 146 includes a fixed hook portion 148 which extends from a base 149 of the heel receiver and a movable hook portion 150 disposed opposite the fixed hook portion. As shown in the drawings, a wedge 172 extends from heel receiver 146 between fixed hook portion 148 and movable hook portion 150. Wedge 172 may have one or more protrusions formed as triangular prisms disposed on outboard sides of the wedge to increase rigidity and decrease lateral motion of the heel portion (e.g., when the wedge is received in a corresponding recess of the heel portion, described below). In the example depicted in FIGS. 2-4, a locking actuator 152 is configured to move the movable hook portion between a retracted position and an extended position. In some examples, a different locking actuator may be used as a direct replacement for actuator 152, for example actuator 252 or actuator 352, described in more detail below.

Hook portions 148 and 150 may be oriented in any suitable direction. In the example depicted in FIGS. 2-4, fixed hook portion 148 faces toward the rear portion of the shoe and movable hook portion 150 faces toward the front of the shoe. Movable hook portion 150 is biased toward the extended (e.g., forward) position. Any suitable biasing device may be used, such as resilient fingers, springs, etc. (see below).

Actuator 152 is operatively connected to movable hook portion 150, such that operation (e.g., manual operation) of actuator 152 against the force of the biasing device causes the movable hook to retract. In this embodiment, actuator 152 is of a single piece with movable hook portion 150. Specifically, the combined movable hook portion 150 and actuator 152 includes a generally triangular manual handle 124, textured for enhanced grippability, as well as an elongate body 126 on which is formed hook 150 and an integral spring member 154. Manual handle 124 is exposed on the underside of the shoe, and accessible by the user.

Body 126 has a generally planar top, configured to slide while in contact with an underside of the outsole. A rear portion of body 126 is received in a cavity 130 formed in heel receiver 146, such that spring member 154 is disposed in cavity 130, and comes in contact with a wall of the cavity. Spring member 154 includes a plurality of resilient fingers or protrusions extending generally sideways (e.g., laterally) across the rear of body 126, such that distal ends of the resilient fingers are spaced from the rear of the body.

Disposed on the underside of body 126 and adjacent manual handle 124 is a locking switch 125 (AKA an actuator portion). Locking switch 125 may comprise any suitable magnetic material, e.g., steel. In the current example, locking switch 125 may be generally L-shaped, defining a shaft portion and actuating portion oriented generally perpendicular to the shaft portion. In this embodiment, locking switch 125 is unitary with a T-stop 127 (AKA a blocking portion) that is generally T-shaped defining a shaft portion and two perpendicular protrusions/legs. T-stop may be configured such that a surface plane of T-stop 127 is oriented generally perpendicular to locking switch 125 (see FIGS. 5-7). A unitary shaft connects the shaft portions of locking switch 125 and T-stop 127. The unitary shaft may be housed within a sheath to protect the shaft and prohibit unwanted movement and/or striking thereof, e.g., while the user is walking.

In some examples, locking actuator 152 includes selected features of actuators 252, 352 (described further below with respect to FIGS. 8, 9). For example, locking switch 225 or locking switch 325 can be utilized in actuator 152 in place of locking switch 125. Similarly, T-stop 227 or stopping end 327 can be utilized in actuator 152 in place of T-stop 127. Furthermore, stopping block 233 or channel 333 can be utilized in conjunction with, or in place of, stopping block 133 (described in more depth below, with respect to FIG. 7). Any compatible component of actuators 152, 252, and 352 may be selectively utilized in combination with, or in place of, the respective corresponding component of any one of the other actuators.

Figure 4:
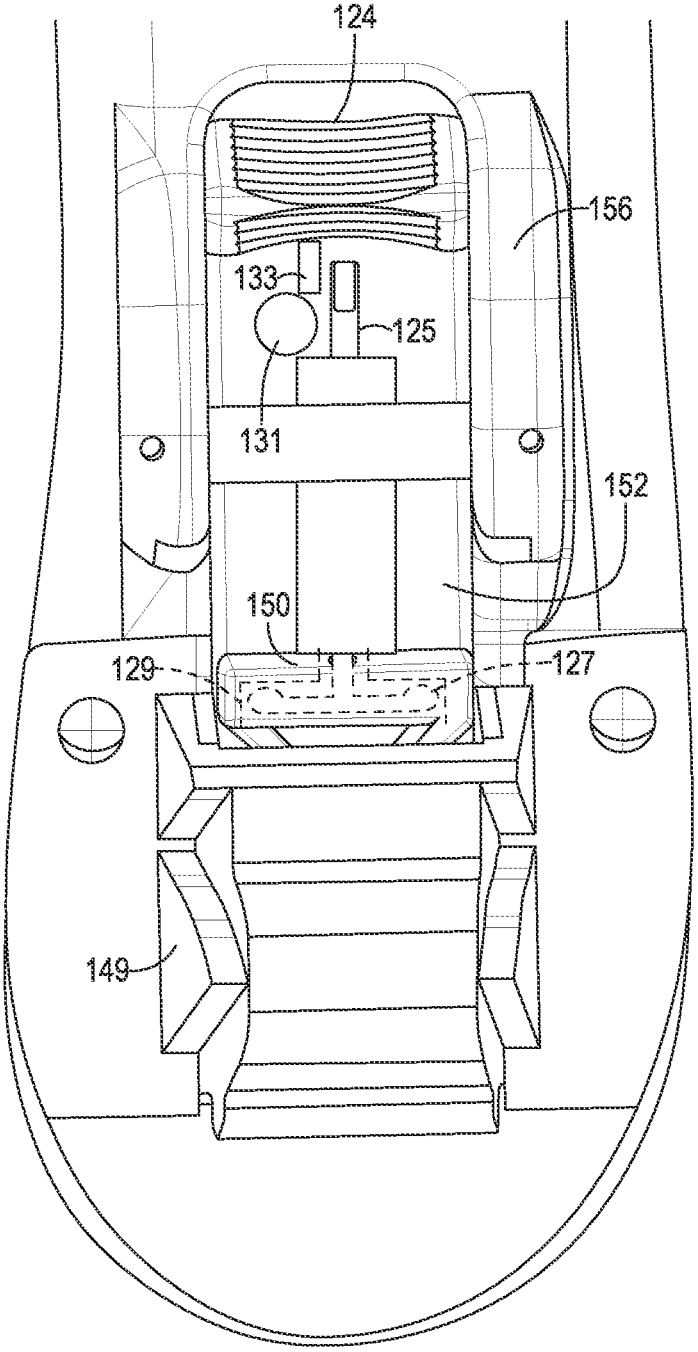
FIG. 4 depicts a heel attachment mechanism and a first locking actuator for use with the convertible shoe of FIG. 1.

As shown in FIG. 4, actuator 152 and movable hook 150 are guided and retained against outsole portion 114 by a pair of side guides 156 and a retainer bar, although any suitable retainer/guide mechanism may be utilized.

As shown in FIG. 4, actuator 152 and movable hook 150 are guided and retained against outsole portion 114 by a pair of side guides 156 and a retainer bar 158, although any suitable retainer/guide mechanism may be utilized.

Heel portions 104 and 106 include respective upper mounting surfaces 160, 162 for attaching the respective heel portion to heel receiver 146. Upper mounting surface 160 includes a first recess 164 configured to engage fixed hook portion 148, and a second recess 168, configured to engage movable hook portion 150. Similarly, upper mounting surface 162 includes a first recess 166 configured to engage fixed hook portion 148, and a second recess 170 configured to engage movable hook portion 150.

Accordingly, heel portion 104 or 106 is secured to the heel receiver when the movable hook portion is in the extended position. The heel portion is releasable from the heel receiver when the movable hook portion is in the retracted position.

Each of upper mounting surfaces 160 and 162 further includes a respective wedge receiver 132, 134. Each of these wedge receivers is configured to snugly mate with wedge 172 of the heel receiver. Specifically, installing heel portion 104 or 106 onto the heel receiver causes wedge 172 to mate with receiver 132 or 134, adding further security and stability to the heel-shoe connection.

Figure 5:
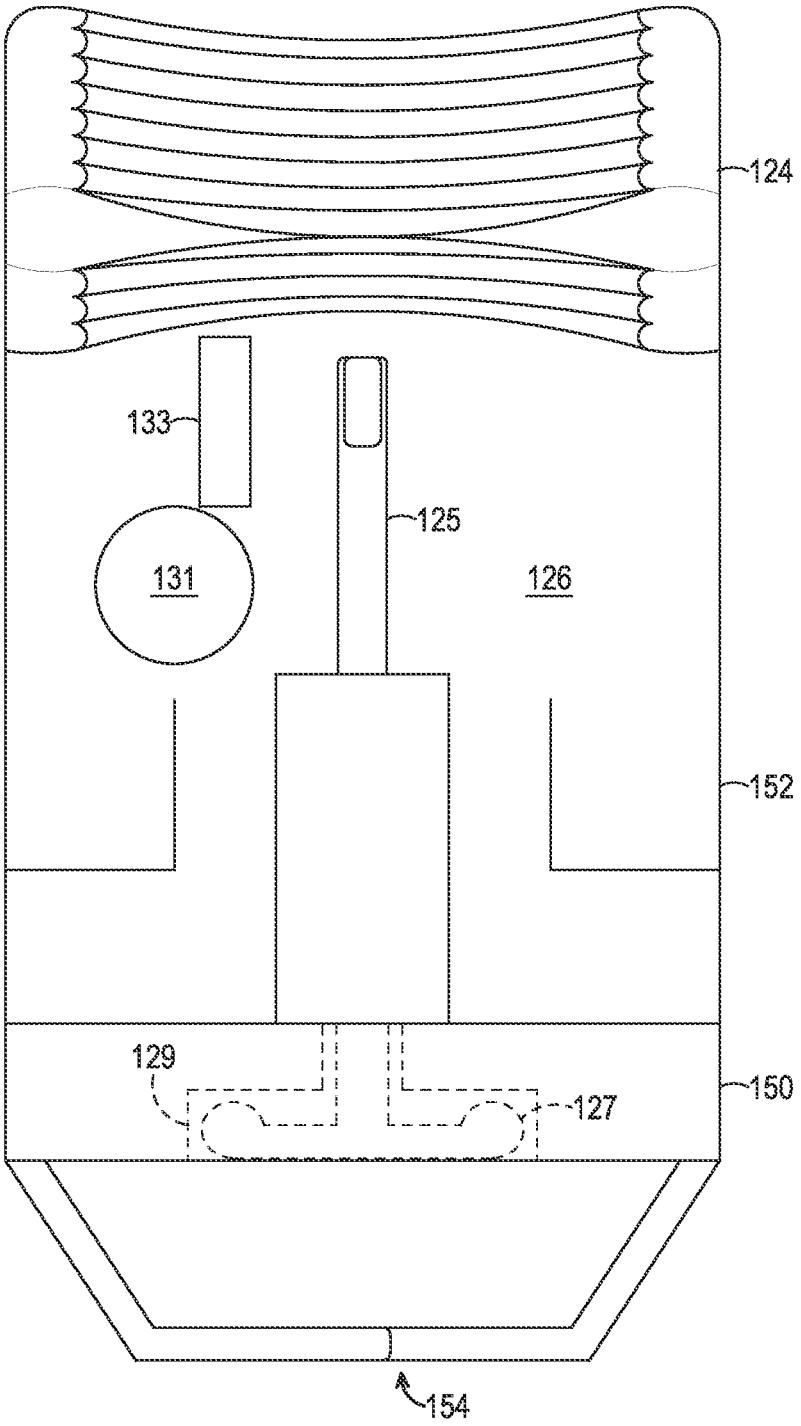
FIG. 5 depicts the actuator of FIG. 4 in a first, unlocked position.

With reference to FIG. 5, when locking switch 125 is in the first position, T-stop 127 is housed within accommodating space 129. This arrangement allows distal ends of the resilient fingers of spring member 154 to freely bend, thus allowing manual operation of actuator 152 and movable hook portion 150. From the first position, the locking switch may be transition to the second position by a manual engagement of a distal end of locking switch 125, e.g., by the user.

Figure 6:
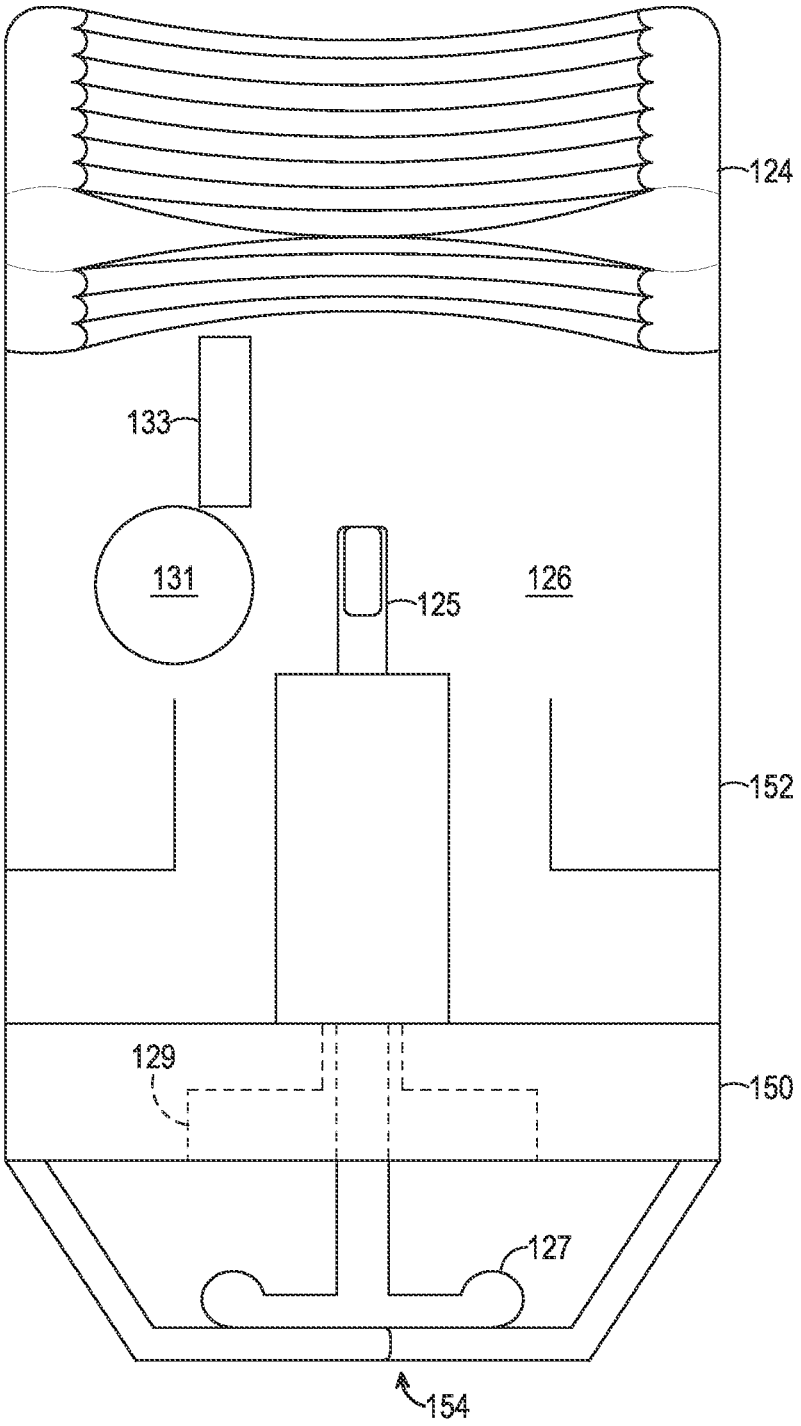
FIG. 6 depicts the actuator of FIG. 4 in a second, extended position.

Turning to FIG. 6, locking switch 125 is shown in the second position. T-stop 127 is shown protruding from accommodating space 129, such that an outer surface of T-stop 127 is substantially coplanar with an inner surface of the resilient fingers of spring member 154. In the second position, locking switch is brought into alignment with a magnet 131. From the second position, the locking switch may be transitioned to the third position by a manual rotation towards magnet 131, e.g., by the user.

Figure 7:
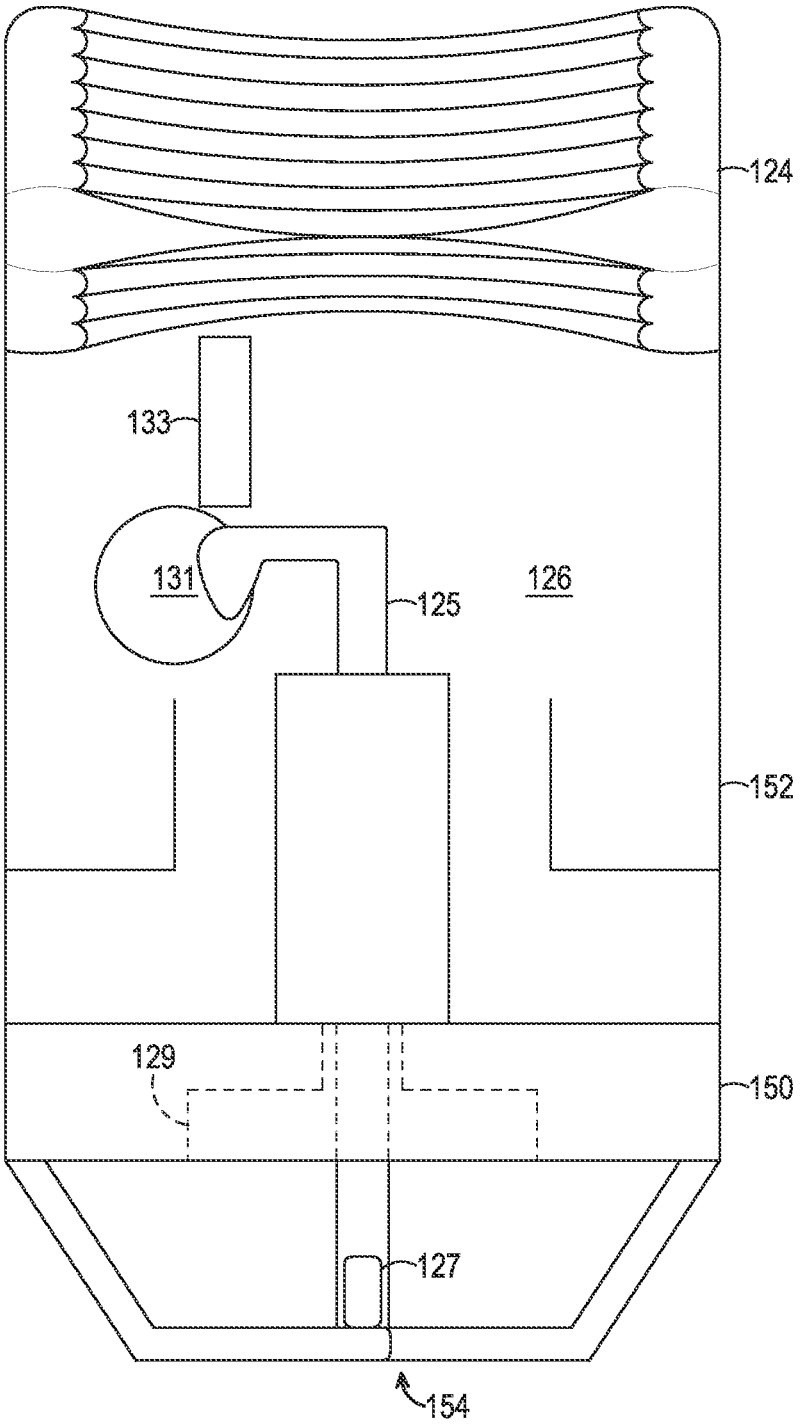
FIG. 7 depicts the actuator of FIG. 4 in a third, locked position.

FIG. 7 depicts locking switch 125 in the third position. In this position, the actuating portion of locking switch 125 is engaged by the magnetic field of magnet 131, thereby ensuring locking switch 125 remains in contact with magnet 131 until a sufficient force is applied to locking switch 125 to overcome the magnetic field. Additionally, locking switch 125 has been brought into contact with stationary block 133, thereby prohibiting locking switch 125 from lateral motion in the direction of manual handle 124.

In FIG. 7, T-stop 127 is shown similarly rotated due to the unitary arrangement of T-stop 127 with locking switch 125. In the third position, the two perpendicular protrusions of T-stop 127 have been brought into the path of the resilient fingers of spring member 154. Any attempt to retract movable hook portion 150, while the locking switch is in the third position, results in spring member 154 abutting T-stop 127. Since T-stop 127 is unitary with locking switch 125 and the motion of the locking switch is prohibited by stationary block 133, spring member 154 is prohibited from bending. Accordingly, the movable hook portion is prohibited from retracting and is maintained in the extended position. Therefore, in the third position, the heel portion is not releasable from the heel receiver.

To release the heel portion, the user must transition the locking switch back to the first position, thus enabling the movable hook portion to be brought into the retracted position.

In operation, shoe 100 may be converted between two or more interchangeable heels as follows. Starting with sole portion 102 having no heel attached and locking switch 125 being in the first position, upper mounting surface 160 of high heel portion 104 may be placed into engagement with heel receiver 146. Specifically, heel portion 104 may be placed at an angle such that fixed hook 148 inserts into first recess 164 and engages therein. The heel portion may then be pivoted upward, such that movable hook 150 comes into contact with the upper mounting surface, forcing the movable hook to retract against spring member 154 and allowing the heel portion to fully engage the heel receiver.

Once fully engaged, spring member 154 forces movable hook 150 to extend into second recess 168. This may be experienced by the user as the heel "snapping" into place. If necessary, actuator 152 may be manually shifted to aid in the process of retracting and/or extending movable hook 150. After the heel is attached, the locking switch may be transitioned from the first position, through the second position, and into the third position as described above, locking the heel into place.

Reversing the process to remove high heel portion 104, locking switch 125 is first transitioned from the third position, through the second position, and to the first position, then actuator 152 is manipulated rearward to retract movable hook 150 against the biasing force of spring member 154, permitting the removal of movable hook 150 from second recess 168 and disengagement of the front side of the heel portion. Heel portion 104 can then be pivoted and removed from fixed hook 148, thereby removing the heel portion altogether.

Similarly, low heel portion 106 can then be installed by placing upper mounting surface 162 of low heel portion 106 into engagement with heel receiver 146. Specifically, heel portion 106 may be placed at an angle such that fixed hook 148 inserts into rear hook-receiving recess 166 and engages therein. The heel portion may then be pivoted upward, such that movable hook 150 comes into contact with the upper mounting surface, forcing the movable hook to retract against spring member 154 and allowing the heel portion to fully engage the heel receiver. Once fully engaged, spring 154 forces movable hook 150 to extend into second recess 170. Again, if necessary, actuator 152 may be utilized to aid in the process of retracting and/or extending movable hook 150. After the heel is attached, the locking switch may be transitioned from the first position, through the second position, and into the third position as described above, locking the heel into place.

Figure 8:
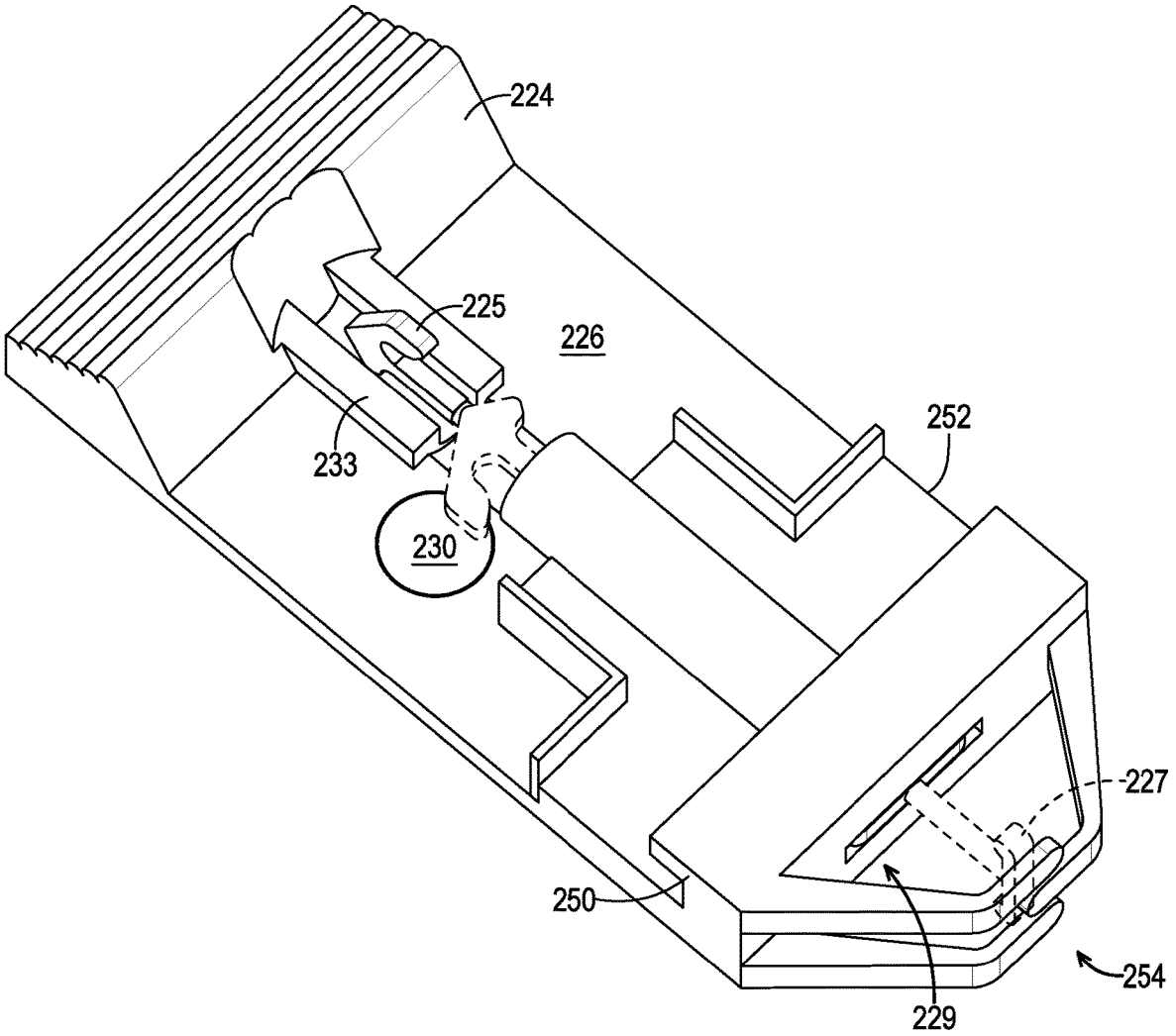
FIG. 8 depicts a second locking actuator for use with the convertible shoe of FIG. 1.

Turning to FIG. 8, another illustrative locking actuator 252 suitable for use with shoe 100 is shown. Actuator 252 is substantially similar to actuator 152, with selected differences described below. In general, actuator 252 directly replaces actuator 152 in some examples of convertible shoe 100. Actuator 252 is transitionable between an unlocked position and a locked position (depicted in dashed lines in FIG. 8).

As with actuator 152, actuator 252 is operatively connected to a movable hook portion 250, such that operation (e.g., manual operation) of actuator 252 against the force of the biasing device causes the movable hook to retract. In this embodiment, actuator 252 is formed as a single piece with movable hook portion 250. The combined movable hook portion 250 and actuator 252 includes a generally triangular manual handle 224, textured for an enhanced grip, as well as an elongate body 226 on which is formed hook 250 and an integral spring member 254. In the example depicted in FIG. 8, spring member 254 comprises a plurality of resilient fingers or protrusions extending generally sideways (e.g., laterally) across the rear of body 226, such that distal ends of the resilient fingers are spaced from the rear of the body. Manual handle 224 is exposed on the underside of the shoe, and accessible by the user.

Body 226 has a generally planar top, configured to slide while in contact with an underside of the outsole. As with actuator 152, a rear portion of body 226 is received in cavity 130 formed in heel receiver 146, such that spring member 254 is disposed within cavity 130, and comes in contact with a wall of the cavity.

A locking switch 225 (AKA an actuator portion) is disposed on the underside of body 226 and adjacent manual handle 224. Locking switch 225 may comprise any suitable magnetic material, e.g., steel. In the current example, locking switch 225 is generally L-shaped, defining a shaft portion and an actuating portion oriented generally perpendicular to the shaft portion. In this embodiment, locking switch 225 is unitary with a T-stop 227 (AKA a blocking portion) that comprises a generally T-shaped structure defined by a shaft portion and two perpendicular protrusions/legs. T-stop 227 is configured such that a plane defined by T-stop 227 is oriented generally perpendicular to locking switch 225. A unitary shaft connects the shaft portions of locking switch 225 and T-stop 227. In other words, the shaft portion of T-stop 227 is a continuation of the same shaft as that of the locking switch. In some embodiments, these two shaft portions may be separate portions coupled together. The unitary shaft of the present example is housed within a sheath to protect the shaft and prohibit unwanted movement and/or striking thereof, e.g., while the user is walking. As described above, with respect to actuator 152, actuator 252 (and movable hook 250) are guided and retained against outsole portion 114 by a pair of side guides 156 and a retainer bar, although any suitable retainer and/or guide mechanism may be utilized.

In some examples, locking actuator 252 includes one or more selected features of actuators 152, 352 (described above and below). For example, locking switch 125 or locking switch 325 can be utilized in actuator 252 in place of locking switch 225. Similarly, T-stop 127 or stopping end 327 can be utilized in actuator 252 in place of T-stop 227. Furthermore, stopping block 133 or channel 333 may be utilized in conjunction with, or in place of, stopping block 233 (described below).

Locking switch 225 and T-stop 227 are transitionable by a user between two operable positions, namely an unlocked position (shown in FIG. 8 in solid lines) and a locked position (shown in FIG. 8 in dashed lines).

When locking switch 225 is in the unlocked position, T-stop 227 is housed within accommodating space 229. This arrangement allows distal ends of the resilient fingers of spring member 254 to freely bend, thus allowing manual operation of actuator 252 and movable hook portion 250.

The locking switch is selectively transitioned to the locked position by manipulating a distal end of locking switch 225, e.g., by the user. In the locked position, the actuating portion of locking switch 225 is retained by magnet 230, ensuring locking switch 225 remains in contact with magnet 230 until a sufficient force is applied to overcome the magnetic field. Additionally, locking switch 225 is arrested by stationary block 233, thereby prohibiting locking switch 225 from lateral motion in the direction of manual handle 224.

Furthermore, in the locked position, T-stop 227 is rotated due to the unitary arrangement of T-stop 227 with locking switch 225. In the locked position, the two perpendicular protrusions of T-stop 227 are brought into the path of the resilient fingers of spring member 254. Any attempt to retract movable hook portion 250, while the locking switch is in the locked position, results in spring member 254 contacting T-stop 227. Since T-stop 227 is unitary with locking switch 225 and the motion of the locking switch is prohibited by stationary block 233, spring member 254 is prohibited from bending. Accordingly, movable hook 250 is prohibited from retracting and is maintained in the extended position. Therefore, in the locked position, the heel portion is secured and not releasable from the heel receiver.

The user must transition the locking switch back to the unlocked position to release the heel portion, as this enables the movable hook portion to be brought into the retracted position.

Figure 9:
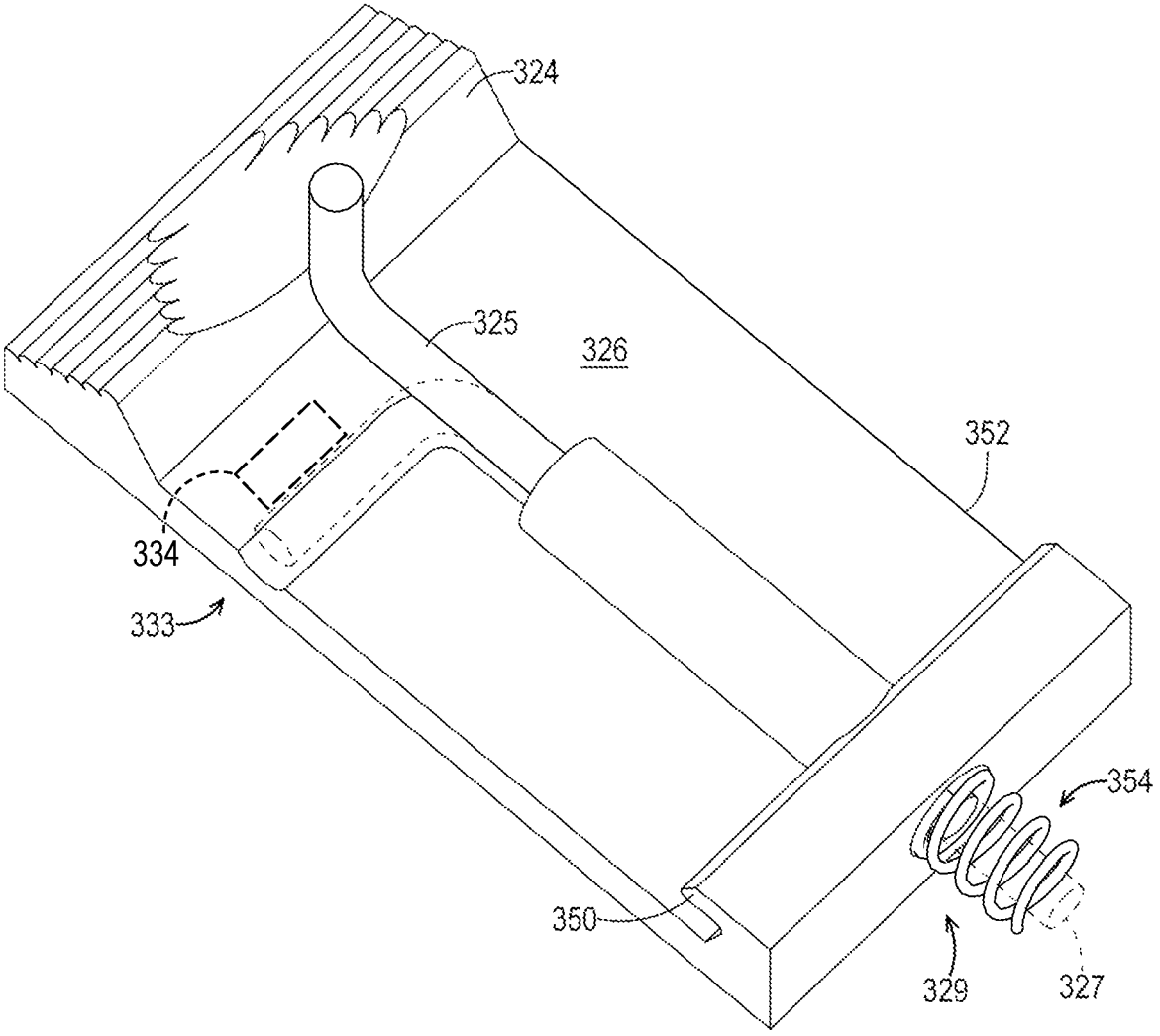
FIG. 9 depicts a third locking actuator for use with the convertible shoe of FIG. 1.

Turning now to FIG. 9, another illustrative locking actuator 352 suitable for use with shoe 100 is shown. Actuator 352 is substantially similar to actuators 152 and 252, with selected differences described below. In general, actuator 352 directly replaces actuator 152 or actuator 252 in some examples of convertible shoe 100. Actuator 352 is transitionable between an unlocked position and a locked position (depicted in dashed lines in FIG. 9).

As with actuators 152, 252, actuator 352 is operatively connected to a movable hook portion 350, such that operation (e.g., manual operation) of actuator 352 against the force of the biasing device causes the movable hook to retract. In this embodiment, actuator 352 is formed as a single piece with movable hook portion 350. The combined movable hook portion 350 and actuator 352 includes a generally triangular manual handle 324, textured for an enhanced grip, as well as an elongate body 326 on which is formed hook 350, and a spring member 354. In the example depicted in FIG. 9, spring member 354 comprises a helical spring on the rear of the body. In some examples, spring member 354 comprises two or more helical springs, e.g., spaced apart from each other. Manual handle 324 is exposed on the underside of the shoe, and accessible by the user.

Body 326 has a generally planar top, configured to slide while in contact with an underside of the outsole. As with actuators 152, 252, a rear portion of body 326 is received in cavity 130 formed in heel receiver 146, such that spring member 354 is disposed within cavity 130 and comes in contact with a rear wall of the cavity.

A locking switch 325 (AKA an actuator portion) is disposed on the underside of body 326 and adjacent manual handle 324. Locking switch 325 may comprise any suitably rigid, long-lasting material, e.g., steel. In the current example, locking switch 325 is generally L-shaped, defining a shaft portion and an actuating portion oriented generally perpendicular to the shaft portion. In this embodiment, locking switch 325 is unitary with a distal stopping end 327 (AKA a blocking portion and/or locking pin). Stopping end 327 may be configured such that a unitary shaft connects locking switch 325 and stopping end 327. In other words, stopping end 327 is a continuation of the same shaft as that of the locking switch. In the present example, the shaft of stopping end 327 is coaxial with the helical spring. In some examples having an offset spring, or more than one helical spring, the shaft and spring(s) are not coaxial. The unitary shaft of the present example is housed within a sheath to protect the shaft and prohibit unwanted movement and/or striking thereof, e.g., while the user is walking. As described above, with respect to actuators 152, 252, actuator 352 (and therefore movable hook 350) are guided and retained against outsole portion 114 by a pair of side guides 156 and a retainer bar, although any suitable retainer/guide mechanism may be utilized.

In some examples, locking actuator 352 includes selected features of actuators 152, 252 (described above). For example, locking switch 125 or locking switch 225 can be utilized in actuator 352 in place of locking switch 325. Similarly, T-stop 127 or T-stop 227 can be utilized in actuator 352 in place of stopping end 327. Furthermore, stopping block 133 or stopping block 233 can be utilized in conjunction with, or in place of, channel 333 (described below).

Locking switch 325 and stopping end 327 are transitionable by a user between two operable positions, namely an unlocked position (shown in FIG. 9 in solid lines) and a locked position (shown in FIG. 9 in dashed lines).

When locking switch 325 is in the unlocked position, stopping end 327 is housed within accommodating space 329. This arrangement allows spring member 354 to freely compress, thus allowing manual operation of actuator 352 and movable hook portion 350. The locking switch is selectively transitioned to the locked position by manipulating a distal end of locking switch 325, e.g., by the user.

In the locked position, the actuating portion of locking switch 325 rests in a channel 333, ensuring locking switch 325 is retained in the locked position (e.g., by prohibiting locking switch 325 from lateral motion in the direction of manual handle 324). In some examples, a stopping block 334 is utilized in conjunction with, or in place of, channel 333 to ensure locking switch 325 is retained in the locked position. In some examples, a magnet (not shown), such as magnet 230 described above, may be utilized in conjunction with channel 333, or instead of channel 333.

Furthermore, in the locked position, stopping end 327 is extended generally through the center of spring member 354. Any attempt to retract movable hook portion 350, while the locking switch is in the locked position, results in stopping end 327 contacting an inner wall of cavity 130. Since stopping end 327 is unitary with locking switch 325 and the motion of the locking switch is prohibited by channel 333, spring member 354 is prohibited from compressing. Accordingly, movable hook 350 is prohibited from retracting and is thus maintained in the extended position. In other words, in the locked position, the heel portion is secured and not releasable from the heel receiver.

The user must transition the locking switch back to the unlocked position to release the heel portion, as this enables movable hook 350 to be brought into the retracted position.

Although a high heel and a low heel are described in the various embodiments herein, any combination of heights, whether different or the same, may be used. For example, shoe 100 may be convertible between similar as well as different heel heights. For example, two high heels, one slightly higher than the other, may be included with sole 102.

B. Illustrative Method of Operation

This section describes steps of an illustrative method for operating the releasable heel and locking mechanism of the present disclosure. Aspects of the devices and footwear described above may be utilized in the method steps described below. Where appropriate, reference may be made to components and systems that may be used in carrying out each step. These references are for illustration, and are not intended to limit the possible ways of carrying out any particular step of the method.

In a first step, the method of securing a removable heel to a shoe includes attaching a removable heel to a heel receiver of a shoe. The heel receiver has a fixed hook portion and a movable hook portion comprising a body received by an internal cavity of the heel receiver and disposed opposite the fixed hook portion, wherein the movable hook portion is configured to move between a retracted position and an extended position, wherein the removable heel is secured to the shoe when the movable hook portion is in the extended position. In some examples, a biasing member is disposed between the movable hook portion and a wall of the internal cavity.

In a second step, the method includes causing an insertion of a locking pin into the internal cavity of the heel receiver to prevent movement of the movable hook portion from the extended position to the retracted position. In some examples, this step includes rotating the locking pin using an actuator portion of the locking pin. The actuator portion may be L-shaped. In some examples, the locking pin has a T-shaped distal end configured to be selectively disposed within the internal cavity. In some examples, the locking pin blocks compression of the biasing member (if present).

In an optional third step, the method includes placing the locking pin into a secured position where the locking pin is prevented from inadvertent movement. In some examples, placing the locking pin into the secured position includes rotating the locking pin. In some examples, placing the locking pin into the secured position includes causing an actuator portion of the locking pin to be retained by a magnet of the shoe. In some examples, placing the locking pin into the secured position includes causing the locking pin to be blocked by a protrusion of the shoe.

C. Illustrative Combinations and Additional Examples

This section describes additional aspects and features of a convertible shoe having a locking actuator, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A0. An article of footwear comprising:

a sole including a heel receiver having a fixed hook portion and a movable hook portion comprising a body received by an internal cavity of the heel receiver and disposed opposite the fixed hook portion, wherein the movable hook portion is configured to move between a retracted position and an extended position;

a first heel releasably securable to the heel receiver, wherein when the first heel is engaged with the heel receiver: (a) the first heel is secured to the heel receiver when the movable hook portion is in the extended position, and (b) the first heel is releasable from the heel receiver when the movable hook portion is in the retracted position; and a locking mechanism having an actuator portion operatively connected to a blocking portion configured to move within the internal cavity of the heel receiver, such that the locking mechanism selectively prevents movement of the movable hook portion into the retracted position.

A1. The article of footwear of A0, wherein the movable hook portion is biased toward the extended position by a resilient member extending between the body of the movable hook portion and a wall of the internal cavity.

A2. The article of footwear of A1, wherein the resilient member comprises a helical spring.

A3. The article of footwear of A1, wherein the resilient member comprises a plurality of resilient fingers.

A4. The article of footwear of A1, wherein the blocking portion of the locking mechanism is further configured to stop the resilient member from compressing when the locking mechanism is in a locked position.

A5. The article of footwear of any one of paragraphs A0 through A4, wherein the body of the movable hook portion includes a channel and the actuator portion is received by the channel when the locking mechanism is in a locked position.

A6. The article of footwear of any one of paragraphs A0 through A5, wherein the blocking portion is T-shaped.

A7. The article of footwear of any one of paragraphs A0 through A6, wherein the body of the movable hook portion includes a magnet, and the actuator portion of the locking mechanism is retained by the magnet when the locking mechanism is in a locked position.

A8. The article of footwear of any one of paragraphs A0 through A7, wherein the actuator portion is L-shaped.

A9. The article of footwear of A8, wherein the actuator portion is releasably trapped by a protrusion when the locking mechanism is in a locked configuration.

A10. The article of footwear of any one of paragraphs A0 through A9, further comprising a second heel releasably securable to the heel receiver.

B0. A method of securing a removable heel to a shoe, the method comprising:

attaching a removable heel to a heel receiver of a shoe, wherein the heel receiver has a fixed hook portion and a movable hook portion comprising a body received by an internal cavity of the heel receiver and disposed opposite the fixed hook portion, wherein the movable hook portion is configured to move between a retracted position and an extended position, wherein the removable heel is secured to the shoe when the movable hook portion is in the extended position; and causing an insertion of a locking pin into the internal cavity to prevent movement of the movable hook portion from the extended position to the retracted position.

B1. The method of B0, further comprising placing the locking pin into a secured position where the locking pin is prevented from inadvertent movement.

B2. The method of B1, wherein placing the locking pin into the secured position includes rotating the locking pin.

B3. The method of B1, wherein placing the locking pin into the secured position includes causing an actuator portion of the locking pin to be retained by a magnet of the shoe.

B4. The method of claim B1, wherein placing the locking pin into the secured position includes causing the locking pin to be blocked by a protrusion of the shoe.

B5. The method of any one of paragraphs B0 through B4, wherein causing the insertion of the locking pin includes rotating the locking pin using an actuator portion of the locking pin.

B6. The method of B5, wherein the actuator portion is L-shaped.

B7. The method of any one of paragraphs B0 through B6, wherein a biasing member is disposed between the movable hook portion and a wall of the internal cavity, and the locking pin blocks compression of the biasing member.

B8. The method of any one of paragraphs B0 through B7, wherein the locking pin has a T-shaped distal end configured to be selectively disposed within the internal cavity.

C0. An article of footwear comprising:

a sole including a heel receiver having a fixed hook portion and a movable hook portion comprising a body received by an internal cavity of the heel receiver and disposed opposite the fixed hook portion, wherein the movable hook portion is configured to move between a retracted position and an extended position;

a first heel releasably securable to the heel receiver, wherein when the first heel is engaged with the heel receiver: (a) the first heel is secured to the heel receiver when the movable hook portion is in the extended position, and (b) the first heel is releasable from the heel receiver when the movable hook portion is in the retracted position; and a locking mechanism having an L-shaped actuator portion operatively connected to a blocking portion configured to move within the internal cavity of the heel receiver, such that the locking mechanism selectively prevents movement of the movable hook portion into the retracted position;

wherein the movable hook portion is biased toward the extended position by a helical spring extending between the body of the movable hook portion and a wall of the internal cavity.

C1. The article of footwear of C0, wherein the blocking portion of the locking mechanism is further configured to be coaxial with the helical spring.

Advantages, Features, and Benefits

The different embodiments and examples of the convertible shoe described herein provide several advantages over known solutions for providing a user with multiple heel options. For example, illustrative embodiments and examples described herein allow simple and secure interchange of different-height heels.

Additionally, and among other benefits, illustrative embodiments and examples described herein allow safe conversion between a high heel and a low heel, without the need for tools.

Additionally, and among other benefits, illustrative embodiments and examples described herein allow an attached heel to be secured to the convertible shoe with multiple locking safety features, adding peace of mind and preventing inadvertent dislodging of the attached heel.

No known system or device can perform these functions. However, not all embodiments and examples described herein provide the same advantages or the same degree of advantage.

Conclusion

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

The invention claimed is:

1. An article of footwear comprising:

a sole including a heel receiver having a fixed hook portion and a movable hook portion comprising a body received by an internal cavity of the heel receiver and disposed opposite the fixed hook portion, wherein the movable hook portion is configured to move between a retracted position and an extended position;

a first heel releasably securable to the heel receiver, wherein when the first heel is engaged with the heel receiver: (a) the first heel is secured to the heel receiver when the movable hook portion is in the extended position, and (b) the first heel is releasable from the heel receiver when the movable hook portion is in the retracted position; and a locking mechanism having an actuator portion operatively connected to a blocking portion configured to move within the internal cavity of the heel receiver, such that the locking mechanism selectively prevents movement of the movable hook portion into the retracted position;

wherein the body of the movable hook portion includes a channel and the actuator portion is received by the channel when the locking mechanism is in a locked position.

2. The article of footwear of claim 1, wherein the movable hook portion is biased toward the extended position by a resilient member extending between the body of the movable hook portion and a wall of the internal cavity.

3. The article of footwear of claim 2, wherein the resilient member comprises a plurality of resilient fingers.

4. The article of footwear of claim 3, wherein the blocking portion of the locking mechanism is further configured to stop the plurality of resilient fingers from compressing when the locking mechanism is in a locked position.

5. The article of footwear of claim 2, wherein the blocking portion of the locking mechanism is further configured to be coaxial with the resilient member.

6. The article of footwear of claim 2, wherein the resilient member comprises a helical spring.

7. The article of footwear of claim 1, wherein the actuator portion is L-shaped.

8. The article of footwear of claim 7, wherein the actuator portion is releasably trapped by a protrusion when the locking mechanism is in a locked configuration.

9. A method of securing a removable heel to a shoe, the method comprising:

attaching a removable heel to a heel receiver of a shoe, wherein the heel receiver has a fixed hook portion and a movable hook portion comprising a body received by an internal cavity of the heel receiver and disposed opposite the fixed hook portion, wherein the movable hook portion is configured to move between a retracted position and an extended position, wherein the removable heel is secured to the shoe when the movable hook portion is in the extended position; and causing an insertion of a locking pin into the internal cavity to prevent movement of the movable hook portion from the extended position to the retracted position, wherein causing the insertion of the locking pin includes rotating the locking pin using an actuator portion of the locking pin.

10. The method of claim 9, further comprising placing the locking pin into a secured position where the locking pin is prevented from inadvertent movement.

11. The method of claim 10, wherein placing the locking pin into the secured position includes causing the locking pin to be blocked by a protrusion of the shoe.

12. The method of claim 9, wherein the actuator portion is L-shaped.

13. The method of claim 9, wherein a biasing member is disposed between the movable hook portion and a wall of the internal cavity, and the locking pin blocks compression of the biasing member.

14. The method of claim 13, wherein the biasing member comprises a helical spring.

15. An article of footwear comprising:

a sole including a heel receiver having a fixed hook portion and a movable hook portion comprising a body received by an internal cavity of the heel receiver and disposed opposite the fixed hook portion, wherein the movable hook portion is configured to move between a retracted position and an extended position;

a first heel releasably securable to the heel receiver, wherein when the first heel is engaged with the heel receiver: (a) the first heel is secured to the heel receiver when the movable hook portion is in the extended position, and (b) the first heel is releasable from the heel receiver when the movable hook portion is in the retracted position; and a locking mechanism having an actuator portion operatively connected to a blocking portion configured to move within the internal cavity of the heel receiver, such that the locking mechanism selectively prevents movement of the movable hook portion into the retracted position;

wherein the body of the movable hook portion includes a magnet, and the actuator portion of the locking mechanism is retained by the magnet when the locking mechanism is in a locked position.

16. A method of securing a removable heel to a shoe, the method comprising:

attaching a removable heel to a heel receiver of a shoe, wherein the heel receiver has a fixed hook portion and a movable hook portion comprising a body received by an internal cavity of the heel receiver and disposed opposite the fixed hook portion, wherein the movable hook portion is configured to move between a retracted position and an extended position, wherein the removable heel is secured to the shoe when the movable hook portion is in the extended position;

causing an insertion of a locking pin into the internal cavity to prevent movement of the movable hook portion from the extended position to the retracted position; and placing the locking pin into a secured position where the locking pin is prevented from inadvertent movement, wherein placing the locking pin into the secured position includes rotating the locking pin.

17. The method of claim 16, wherein a biasing member is disposed between the movable hook portion and a wall of the internal cavity, and the locking pin blocks compression of the biasing member.

18. The method of claim 17, wherein the biasing member comprises a helical spring.

19. A method of securing a removable heel to a shoe, the method comprising:

attaching a removable heel to a heel receiver of a shoe, wherein the heel receiver has a fixed hook portion and a movable hook portion comprising a body received by an internal cavity of the heel receiver and disposed opposite the fixed hook portion, wherein the movable hook portion is configured to move between a retracted position and an extended position, wherein the removable heel is secured to the shoe when the movable hook portion is in the extended position;

causing an insertion of a locking pin into the internal cavity to prevent movement of the movable hook portion from the extended position to the retracted position; and placing the locking pin into a secured position where the locking pin is prevented from inadvertent movement, wherein placing the locking pin into the secured position includes causing an actuator portion of the locking pin to be retained by a magnet of the shoe.

20. A method of securing a removable heel to a shoe, the method comprising:

attaching a removable heel to a heel receiver of a shoe, wherein the heel receiver has a fixed hook portion and a movable hook portion comprising a body received by an internal cavity of the heel receiver and disposed opposite the fixed hook portion, wherein the movable hook portion is configured to move between a retracted position and an extended position, wherein the removable heel is secured to the shoe when the movable hook portion is in the extended position; and causing an insertion of a locking pin into the internal cavity to prevent movement of the movable hook portion from the extended position to the retracted position, wherein the locking pin has a T-shaped distal end configured to be selectively disposed within the internal cavity.

* * * * *